US006388367B1

(12) United States Patent
Taguchi

(10) Patent No.: US 6,388,367 B1
(45) Date of Patent: May 14, 2002

(54) APERTURE GRILLE FOR A CRT HAVING DAMPING MEMBERS ARRANGED OUTSIDE OF A SCREEN REGION

(75) Inventor: Hiromichi Taguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/174,425

(22) Filed: Oct. 19, 1998

(30) Foreign Application Priority Data

Oct. 20, 1997 (JP) ..... 9-286816

(51) Int. Cl.[7] ..... H01J 29/80

(52) U.S. Cl. ..... 313/402; 313/404; 313/407; 313/269

(58) Field of Search ..... 313/402, 404, 313/405, 406, 407, 408, 479, 313, 326

(56) References Cited

U.S. PATENT DOCUMENTS

| | | | | |
|---|---|---|---|---|
| 3,638,063 A | | 1/1972 | Tackikawa | 313/348 |
| 4,780,641 A | * | 10/1988 | Hashiba et al. | 313/404 |
| 4,827,179 A | * | 5/1989 | Adler et al. | 313/402 |
| 5,363,011 A | | 11/1994 | Fendley | 313/408 |
| 5,369,330 A | * | 11/1994 | Aibara | 313/402 |
| 5,382,871 A | * | 1/1995 | Funahashi et al. | 313/402 |
| 5,406,168 A | | 4/1995 | Takagi | 313/402 |
| 5,451,833 A | * | 9/1995 | Tong | 313/402 |
| 6,054,803 A | * | 4/2000 | Saita | 313/402 |

FOREIGN PATENT DOCUMENTS

| | | |
|---|---|---|
| JP | 07296739 | 11/1995 |
| JP | 10269961 | 10/1998 |

* cited by examiner

*Primary Examiner*—Ashok Patel
*Assistant Examiner*—Mariceli Santiago
(74) *Attorney, Agent, or Firm*—Ronald P. Kananen; Rader, Fishman & Grauer

(57) ABSTRACT

An aperture grille which can suppress vibrations of a flat grille without marring the appearance of a screen by not arranging damper lines inside an effective screen region of a cathode-ray tube. A pair of damper members 130A and 130B for damping the vibrations of a flat grille 110 are provided in upper and lower regions of the flat grille 110 outside an effective screen region of a cathode-ray tube. The damper members 130A and 130B are supported under a given tension by support members 132 and 134 mounted on second frames 124A and 124B of a frame member, thereby keeping pressure contact with the surface of the flat grille 110. Because the damper members 130A and 130B are not exposed to the effective screen region of the cathode-ray tube, the damper members 130A and 130B are out of sight from the front side of the screen, thus suppressing the vibrations of the flat grille 110 without marring the appearance of the screen.

22 Claims, 6 Drawing Sheets

▼ ; NO DAMPERS

● ; PRIOR ART (FIG. 1)

■ ; PREFERRED EMBODIMENT OF THE INVENTION (FIG. 2)

FIG. 7

| KIND OF DAMPERS | DAMPING TIME (SEC) |
|---|---|
| NO DAMPERS | 320 |
| PRIOR ART (FIG. 1) | 8 |
| PREFERRED EMBODIMENT OF THE INVENTION (FIG. 2) | 8 |

MEASURED WITH 20-INCH CRT

FIG. 8

| KIND OF DAMPERS | SOUND LEVEL |
|---|---|
| NO DAMPERS | 10 % |
| PRIOR ART (FIG. 1) | 80% |
| PREFERRED EMBODIMENT OF THE INVENTION (FIG. 2) | 80% |

MEASURED WITH 28-INCH CRT

APERTURE GRILLE FOR A CRT HAVING DAMPING MEMBERS ARRANGED OUTSIDE OF A SCREEN REGION

BACKGROUND OF THE INVENTION

The present invention relates to an aperture grille used in a Trinitron brand color cathode-ray tube.

A related art Trinitron brand color cathode-ray tube includes a single electron gun for emitting RGB electron beams, a stripe phosphor screen, and an aperture grille as a color separating mechanism.

The aperture grille is provided in the cathode-ray tube so as to be opposed to the stripe phosphor screen provided on the inner surface of a front panel with a given space defined between the aperture grille and the phosphor screen, thereby leading the electron beams emitted from the electron gun to the phosphor screen.

FIG. 1 is a perspective view showing the configuration of such a related art aperture grille.

The aperture grille has a flat grille 10 formed with vertical stripes of slits 12 and line electrodes 14 by etching or the like of a soft steel sheet, and a steel frame member 20 to which the flat grille 10 is connected by welding or the like under a given tension.

The frame member 20 has a pair of first frames 22A and 22B connected to the vertical opposite ends of the flat grille 10 corresponding to the longitudinal opposite ends of the slits 12, and a pair of second frames 24A and 24B connected to the horizontal opposite ends of the first frames 22A and 22B so as to extend between the first frames 22A and 22B.

Two damper lines 16A and 16B are provided on the surface of the flat grille 10 so as to extend in a direction perpendicular to the slits 12.

The damper lines 16A and 16B function to suppress resonance of the flat grille 10 due to forced vibration by an external force. The damper lines 16A and 16B are supported under a given tension by two pairs of spring members 26 mounted on the second frames 24A and 24B, thereby keeping contact with the line electrodes 14 of the flat grille 10.

In the related art aperture grille mentioned above, however, the damper lines 16A and 16B are located on a substantially central portion of the flat grille 10 in respect of its vertical direction. Accordingly, a part of each of the damper lines 16A and 16B is located inside an effective screen region of the cathode-ray tube.

As a result, there is a possibility that the damper lines 16A and 16B may come into sight from the front side of the screen, thus marring the appearance of the screen.

SUMMARY OF THE INVENTION

It is accordingly an object of the present invention to provide an aperture grille which can suppress vibrations of the flat grille without marring the appearance of the screen by not locating the damper lines inside the effective screen region of the cathode-ray tube.

According to the present invention, there is provided in an aperture grille for a cathode-ray tube, having a flat grille as an electrode sheet formed with vertical stripes of slits and line electrodes, and a frame member to which said flat grille is connected under a given tension, the improvement comprising a damper member exposed to a region of said flat grille outside an effective screen region of said cathode-ray tube and kept in contact with said flat grille to suppress vibrations of said flat grille.

With the above configuration of the aperture grille according to the present invention, vibrations of the flat grille due to forced vibration by an external force can be suppressed by the damper member kept in contact with the flat grille, thus preventing resonance of the flat grille. Furthermore, the damper member is out of sight from the front side of the screen of the cathode-ray tube, because the damper member is provided in a region of the flat grille outside the effective screen region of the cathoderay tube. Accordingly, vibrations of the flat grille can be suppressed without marring the appearance of the screen.

BRIEF DESCRIPTION OF THE DRAWINGS

FIG. 7 is a table showing the results of measurement of the vibration damping effect of the aperture grille shown in FIG. 2 as obtained by a method different from the method shown in FIG. 5 in comparison with the related art.

FIG. 8 is a table showing the results of measurement of the vibration damping effect of the aperture grille shown in FIG. 2 as obtained by a method different from the methods shown in FIGS. 5 and 7 in comparison with the related art.

DETAILED DESCRIPTION OF THE PREFERRED EMBODIMENTS

A preferred embodiment of the aperture grille according to the present invention will now be described.

Figure 2:
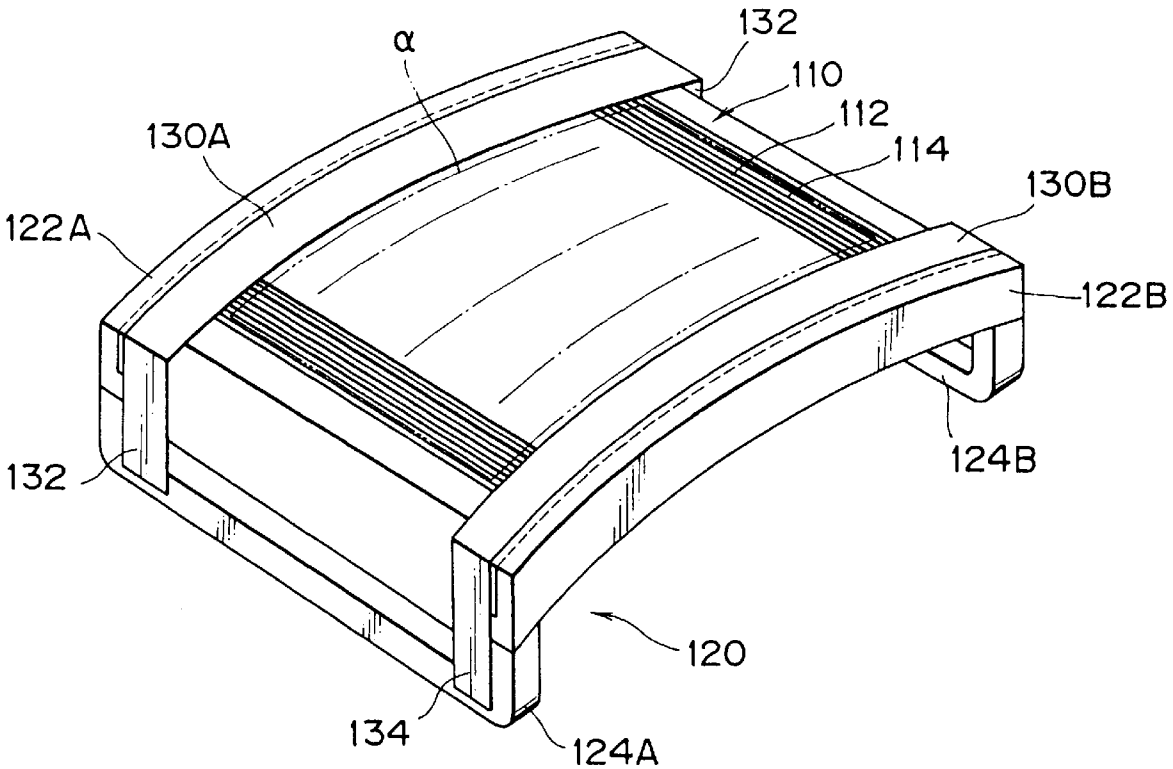
FIG. 2 is a perspective view showing a preferred embodiment of the aperture grille according to the present invention.
Figure 3:
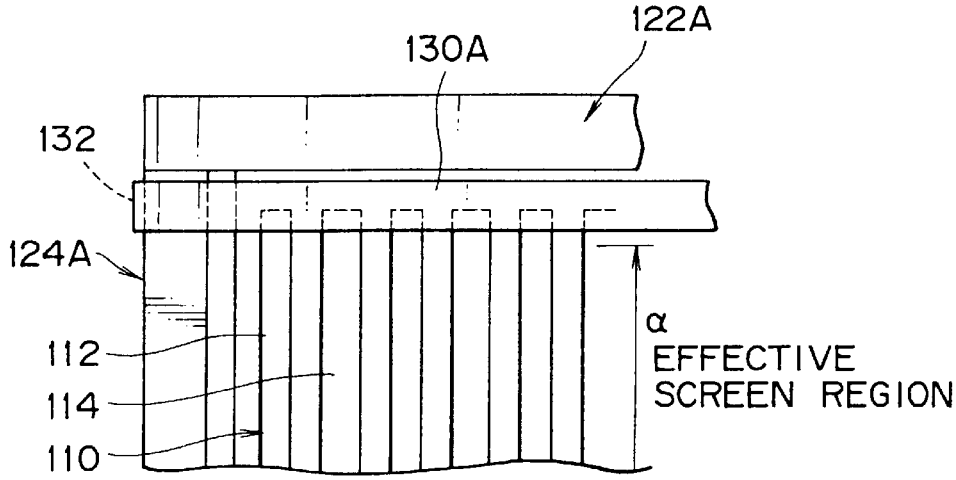
FIG. 3 is an elevational view of a part of the aperture grille shown in FIG. 2.
Figure 4:
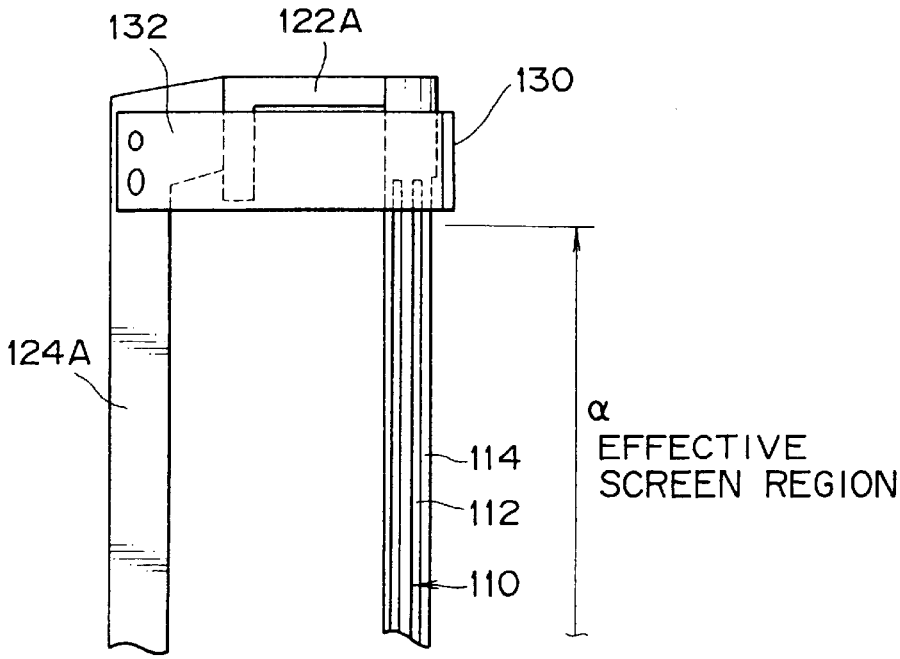
FIG. 4 is a side view of a part of the aperture grille shown in FIG. 2.

FIG. 2 is a perspective view showing a preferred embodiment of the aperture grille according to the present invention. FIG. 3 is an elevational view of a part of the aperture grille shown in FIG. 2, and FIG. 4 is a side view of a part of the aperture grille shown in FIG. 2.

The aperture grille has a flat grille 110 formed with vertical stripes of slits 112 and line electrodes 114 by etching or the like of a soft steel sheet, and a steel frame member 120 to which the flat grille 110 is connected by welding or the like under a given tension.

The frame member 120 has a pair of first frames 122A and 122B connected to the vertical opposite ends of the flat grille 110 corresponding to the longitudinal opposite ends of the slits 112, and a pair of second frames 124A and 124B connected to the horizontal opposite ends of the first frames 122A and 122B so as to extend between the first frames 122A and 122B.

The frame member 120 is mounted in a funnel of a cathode-ray tube through a spring member not shown, and the aperture grille is spaced a given distance from a stripe phosphor screen of the cathode-ray tube.

The aperture grille is provided with a pair of damper members 130A and 130B exposed to upper and lower regions of the flat grille 110 outside an effective screen region α of the cathode-ray tube and kept in contact with the flat grille 110 to suppress vibrations thereof.

The damper members 130A and 130B are formed as metal strips extending along the vertical opposite ends of the flat grille 110 so as to cover the longitudinal opposite ends of the slits 112.

The metal strips may be provided by stainless steel, steel, aluminum alloy, or any other metal strips, or by surface-treated metal strips. Each metal strip has a thickness ranging from 0.01 mm to 0.1 mm.

The damper members 130A and 130B are supported under a given tension by two pairs of support members 132 and 134, respectively, provided on the horizontal opposite ends of the flat grille 110.

The support members 132 and 134 are formed as leaf springs having base ends fixed by welding or the like to the side surfaces of the second frames 124A and 124B, respectively, and front ends extending to a position exposed to the flat grille 110.

The damper member 130A is connected at its opposite ends to the front ends of the support members 132 by welding or bonding. Similarly, the damper member 130B is connected at its opposite ends to the front ends of the support members 134 by welding or bonding.

The damper members 130A and 130B are stretched on the surface of the flat grille 110 under a given tension by the spring forces of the support members 132 and 134, thereby keeping contact with the flat grille 110 under a given contact pressure.

With the above configuration of the aperture grille, vibrations of the flat grille 110 due to forced vibration by an external force can be suppressed by frictional forces of the damper members 130A and 130B kept in contact with the flat grille 110, thus preventing resonance of the flat grille 110.

Furthermore, the damper members 130A and 130B are out of sight from the front side of the screen of the cathode-ray tube, because they are provided in the. upper and lower regions of the flat grille 110 outside the effective screen region α of the cathode-ray tube.

Accordingly, vibrations of the flat grille 110 can be suppressed without marring the appearance of the screen.

The vibration damping effect of the aperture grille having the damper members 130A and 130B will now be described with reference to measured results.

Figure 5:
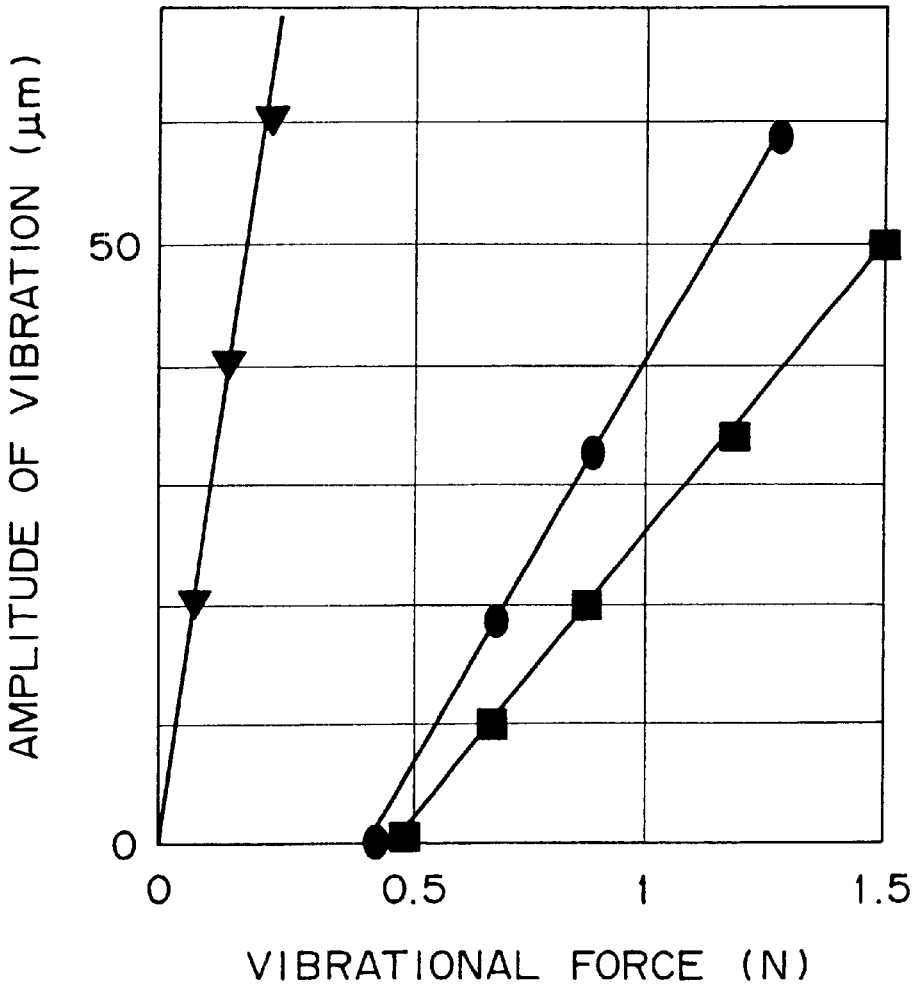
FIG. 5 is a graph showing the results of measurement of the vibration damping effect of the aperture grille shown in FIG. 2 in comparison with the related art.
Figure 6:
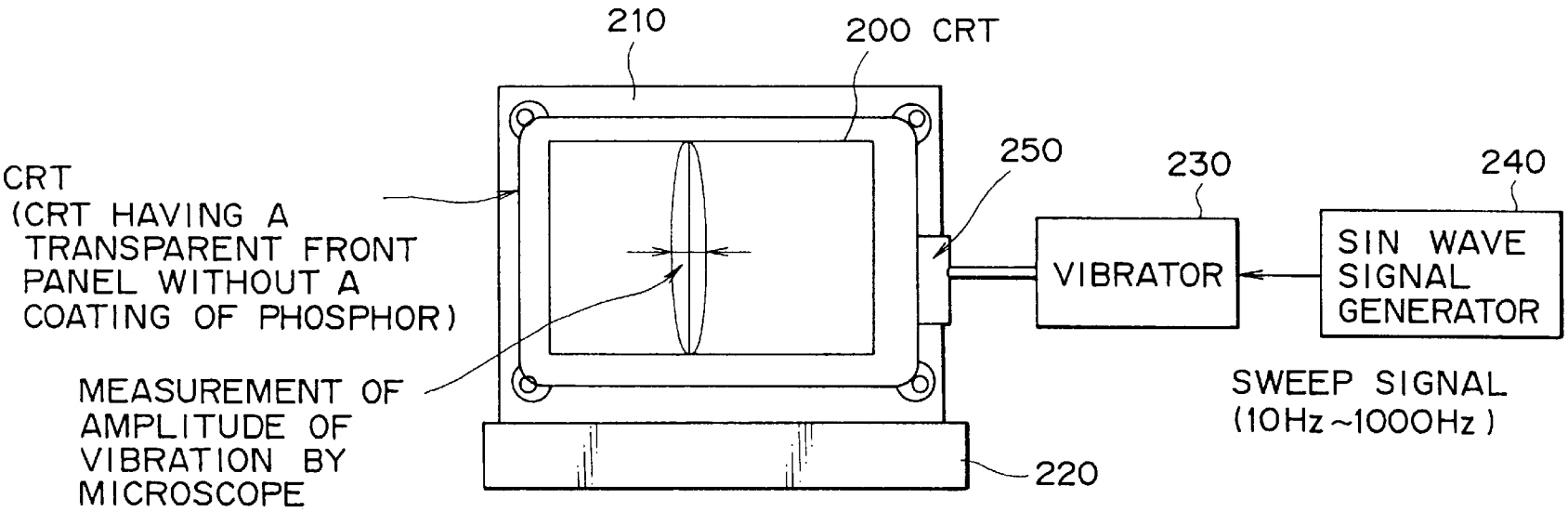
FIG. 6 is a schematic view showing the configuration of a measuring system for obtaining the measured results shown in FIG. 5.

FIG. 5 is a graph showing the results of measurement of the amplitude of vibrations of the line electrodes in the case of applying forced vibration to the cathode-ray tube (CRT) in comparison with the related art, and FIG. 6 is a schematic view showing the configuration of a measuring system for the measurement.

As shown in FIG. 6, a cathode-ray tube 200 as a subject to be measured is incorporated in a TV set 210. The TV set 210 is fixedly placed on a bed 220. Forced vibration is applied from an external vibrator 230 to the TV set 210.

A SWEEP-SIN wave signal of 10 Hz to 1000 Hz is supplied from a SIN wave signal generator 240 to the vibrator 230, and a vibrational force (N) by the vibrator 230 according to this signal is detected by a force sensor 250 provided on the TV set 210.

The cathode-ray tube 200 used for this measurement is a cathode-ray tube having a transparent front panel without a coating of phosphor. The amplitude of vibrations of the line electrodes is measured from the outside of the front panel by using a microscope.

Figure 1:
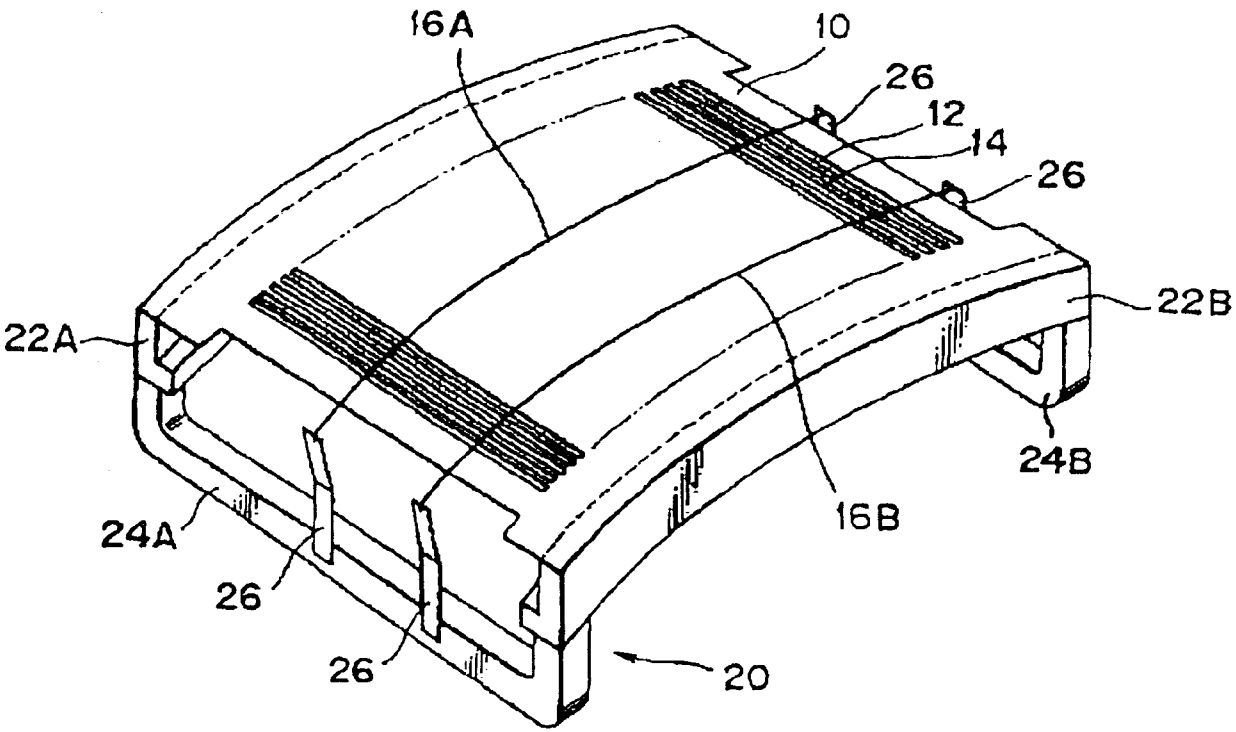
FIG. 1 (PRIOR ART)
FIG. 1 is a perspective view showing a related art aperture grille.

Referring to FIG. 5, reference symbol ▼ shows a sample obtained in the case that the above measurement was carried out in the condition of no dampers, and reference symbol ● shows a sample obtained in the case that the above measurement was carried out in the condition where the damper lines 16A and 16B in the related art shown in FIG. 1 were provided.

In contrast, reference symbol ■ shows a sample obtained in the case that the above measurement was carried out in the condition where the damper members 130A and 130B in the preferred embodiment shown in FIG. 2 were provided. More specifically, a spring stainless steel sheet having a thickness of 10 μm and a width of 15 mm was used as each of the damper members 130A and 130B. Further, a 28-inch cathode-ray tube was used for the above measurement shown in FIG. 5.

It is apparent from FIG. 5 that the damper members 130A and 130B in the preferred embodiment have a vibration damping effect similar to that of the damper lines 16A and 16B in the related art.

FIG. 7 shows the results of measurement of a damping time from the time a hammer shock was applied to the cathode-ray tube incorporated in the TV set to vibrate it to the time the vibrations of the aperture grille came out of sight from the front side of the screen in comparison with the related art. The cathode-ray tube used for the measurement shown in FIG. 7 was a 20-inch cathoderay tube.

As shown in FIG. 7, the damping time in the case of no dampers is 320 seconds, whereas the damping time both in the case of providing the damper lines 16A and 16B in the related art and in the case of providing the damper members 130A and 130B in this preferred embodiment is 8 seconds.

Thus, it is understood also from these measured results that the damper members 130A and 130B in this preferred embodiment have a vibration damping effect similar to that of the damper lines 16A and 16B in the related art.

FIG. 8 shows the results of measurement of a sound level where the cathode-ray tube incorporated in the TV set was vibrated by SWEEP-SIN waves of 10 HZ to 1000 HZ generated from a built-in speaker and the vibrations of the aperture grille came into sight from the front side of the screen in comparison with the related art. The cathode-ray tube used for the measurement shown in FIG. 8 was a 28-inch cathode-ray tube.

As shown in FIG. 8, the vibrations appear at a sound level of 10% in the case of no dampers. In contrast, the vibrations appear at a sound level of 80% both in the case of providing the damper lines 16A and 16B in the related art and in the case of providing the damper members 130A and 130B in this preferred embodiment.

Thus, it is understood also from these measured results that the damper members 130A and 130B in this preferred embodiment have a vibration damping effect similar to that of the damper lines 16A and 16B in the related art.

Consequently, in comparison with the related art, this preferred embodiment can exhibit a similar vibration damping effect and can effectively eliminate the defect in the related art in respect of the appearance of the screen, thereby contributing to the improvement in quality of a cathode-ray tube.

While the damper members are arranged along the vertical opposite ends of the flat grille corresponding to the longitudinal opposite ends of the slits in the above preferred embodiment, the damper members may be arranged along the horizontal opposite ends of the flat grille corresponding to the lateral opposite ends of the slits.

While each damper member is in the form of strip in the above preferred embodiment, it may be in the form of wire or coil spring. Further, each damper member may be formed of any materials such as elastic materials, heat-resistant polymeric materials, and inorganic materials.

Further, the mounting structure for the damper members is not limited to that shown, but any structure capable of making contact of the damper members with the flat grille under a given tension may be adopted. For example, the damper members may be fixed to the first frames or the flat grille directly or through support members by welding or bonding.

What is claimed is:

1. In an aperture grille for a cathode-ray tube, having a flat grille as an electrode sheet formed with vertical stripes of slits and line electrodes, and a frame member to which said flat grille is connected under a given tension, the frame member having a pair of first frames connected to opposite ends of said flat grille corresponding to opposite ends of said slits; the improvement comprising a damper member exposed exterior to a region of said flat grille, entirely outside an effective screen region of said cathode-ray tube, and entirely inside a region defined by inner walls of said first frames, and kept in contact with said flat grille to suppress vibrations of said flat grille.

2. An aperture grille according to claim 1, further comprising a pair of support members provided on said frame member for supporting said damper member under a given tension parallel to the surface of said flat grille.

3. An aperture grille according to claim 1, wherein said damper member comprises a pair of damper members extending along the horizontal opposite ends of said flat grille corresponding to the lateral opposite ends of said slits.

4. An aperture grille according to claim 1, wherein said damper member is in the form of strip, wire, or coil spring.

5. An aperture grille according to claim 1, wherein said damper member is formed of an elastic material, metallic material, heat-resistant polymeric material, or inorganic material.

6. An aperture grille according to claim 1, wherein said damper member is fixed to said frame member by welding or bonding.

7. An aperture grille according to claim 1, wherein said damper member is fixed to said flat grille by welding or bonding.

8. An aperture grille according to claim 1, wherein the pair of first frames are connected to the vertical opposite ends of said flat grille corresponding to the longitudinal opposite ends of said slits, and said frame member further comprises a pair of second frames connected to the horizontal ends of said first frames so as to extend between said first frames.

9. An aperture grille according to claim 1, wherein said damper member comprises a pair of damper members extending along the vertical opposite ends of said flat grille so as to cover the longitudinal opposite ends of said slits.

10. An aperture grille according to claim 9, wherein each of said pair of damper members is a metal strip extending along an end of said flat grille.

11. An aperture grille member according to claim 10 wherein said metal strip has a thickness range from 0.01 mm to 0.1 mm.

12. An aperture grille according to claim 1, wherein said damper member is a metal strip extending along an end of said flat grille.

13. An aperture grille member according to claim 12 wherein said metal strip has a thickness range from 0.01 mm to 0.1 mm.

14. An aperture grille according to claim 12, wherein the a pair of first frames are connected to the vertical opposite ends of said flat grille corresponding to the longitudinal opposite ends of said slits, and said frame member further comprises a pair of second frames connected to the horizontal opposite ends of said first frames so as to extend between said first frames, said aperture grille further comprising a pair of support members provided on said frame member for supporting said damper member under a given tension parallel to the surface of said flat grille, wherein said support members are formed as leaf springs respectively fixed to surfaces of said second frames, and first ends extending to a position exposed to the flat grille.

15. An apparatus for a cathode ray tube, comprising:

a flat grille as an electrode sheet having vertical stripes of slits and line electrodes;

a frame member connecting said flat grille under a given tension, the frame member having a pair of first frames connected to opposite ends of said flat grille corresponding to opposite ends of said slits; and at least one damper member exposed exterior to a region of said flat grille, entirely outside an effective screen region of said cathode-ray tube, and entirely inside a region defined by inner walls of said first frames, and contacting said flat grille to suppress vibrations of said flat grille, further comprising a pair of support members provided on said frame member for supporting said damper member under a given tension parallel to the surface of said flat grille.

16. An apparatus according to claim 15, wherein said damper member comprises a pair of damper members extending along the vertical opposite ends of said flat grille so as to cover the longitudinal opposite ends of said slits.

17. An aperture grille according to claim 15, wherein said damper member comprises a pair of damper members extending along the horizontal opposite ends of said flat grille corresponding to the lateral opposite ends of said slits.

18. An aperture grille according to claim 17, wherein said damper member is fixed to said flat grille.

19. An apparatus according to claim 15, wherein the pair of first frames are connected to the vertical opposite ends of said flat grille corresponding to the longitudinal opposite ends of said slits and said aperture grille further comprises a pair of second frames connected to the horizontal opposite ends of said first frames so as to extend between said first frames.

20. An apparatus for a cathode ray tube, comprising:

a flat grille as an electrode sheet having vertical stripes of slits and line electrodes;

a frame member connecting said flat grille under a given tension, the frame member having a pair of first frames connected to opposite ends of said flat grille corresponding to opposite ends of said slits; and means for damping vibrations of said flat grille, said damping means located exterior to a region of said flat grille, entirely outside an effective screen region of said cathode-ray tube, and entirely inside a region defined by inner walls of said first frames, and contacting said flat grille to suppress vibrations of said grille.

21. An aperture grille according to claim 20, wherein said damping means includes a pair of damper members extending along opposite ends of said flat grille.

22. An apparatus according to claim 20, wherein the pair of first frames are connected to the vertical opposite ends of said flat grille corresponding to the longitudinal opposite ends of said slits and said aperture grille further comprises a pair of second frames connected to the horizontal opposite ends of said first frames so as to extend between said first frames, said apparatus further comprising a pair of support members provided on said frame member for supporting said damper member under a given tension parallel to the surface of said flat grille.

* * * * *

UNITED STATES PATENT AND TRADEMARK OFFICE

CERTIFICATE OF CORRECTION

PATENT NO. : 6,388,367 B1
DATED : May 14, 2002
INVENTOR(S) : Hiromichi Taguchi

It is certified that error appears in the above-identified patent and that said Letters Patent is hereby corrected as shown below:

Title page,

Item [57], ABSTRACT, should read:

-- An aperture grille which can suppress vibrations of a flat grille without marring the appearance of a screen by not arranging damper lines inside an effective screen region of a cathode-ray tube. A pair of damper members 130A and 130B for damping the vibrations of a flat grille 110 are provided in upper and lower regions of the flat grille 110 outside an effective screen region of a cathode-ray tube. The damper members 130A and 130B are supported under a given tension by support members 132 and 134 mounted on second frames 124A and 124B of a frame member, thereby keeping pressure contact with the surface of the flat grille 110. The damper members 130A and 130B are out of sight from the front side of the screen. --

Signed and Sealed this

Sixth Day of May, 2003

JAMES E. ROGAN
*Director of the United States Patent and Trademark Office*